US005553535A

United States Patent [19]

Lucas

[11] Patent Number: 5,553,535

[45] Date of Patent: Sep. 10, 1996

[54] ALUMINUM BEVERAGE CAN CRUSHER

[76] Inventor: Steven Lucas, 32390 W. Peters & Nall Rd., Maricopa, Ariz. 85239

[21] Appl. No.: 543,371

[22] Filed: Oct. 16, 1995

[51] Int. Cl.[6] ..... B30B 3/06; B30B 9/32

[52] U.S. Cl. ..... 100/157; 100/902; 241/228

[58] Field of Search ..... 100/157, 902; 241/228

[56] References Cited

U.S. PATENT DOCUMENTS

| | | | |
|---|---|---|---|
| 2,682,832 | 7/1954 | Lohre et al. | 100/157 |
| 2,795,184 | 6/1957 | Graham et al. | 100/157 |
| 3,631,794 | 1/1972 | Wehner | 100/157 |
| 4,014,256 | 3/1977 | Davis, Jr. | 100/902 |
| 4,444,100 | 4/1984 | Newman | 100/157 |
| 4,573,405 | 3/1986 | Morlock | 100/157 |
| 5,095,815 | 3/1992 | Baumgartner | 100/157 |

FOREIGN PATENT DOCUMENTS

| | | | |
|---|---|---|---|
| 1196535 | 11/1959 | France | 100/157 |
| 341880 | 10/1921 | Germany | 100/157 |
| 12223 | 10/1898 | Sweden | 100/157 |

*Primary Examiner*—Stephen F. Gerrity

[57] ABSTRACT

A non-galling, jam resistant aluminum beverage can crusher is disclosed.

13 Claims, 3 Drawing Sheets

ALUMINUM BEVERAGE CAN CRUSHER

FIELD OF THE INVENTION

This invention relates to recycling of aluminum and specifically to the recycling of aluminum beverage cans and, with more particularity, to a crusher for use in recycling aluminum beverage cans.

BACKGROUND OF THE INVENTION

The field of aluminum can crushing is a crowded art. The prior art discloses a vast number of different approaches to crushing aluminum cans ranging from hand crushers for use by the consumer in the home or business to very large industrial crushers for use in recycling yards which handle millions of cans in any given month. Included within the prior art are many kinds of cans of intermediate capacity for crushing cans one at a time but automatically. One such device is disclosed in U.S. Pat. No. 4,573,405 to Morlock, Mar. 4, 1986 and a similar concept is disclosed by Baumgartner, U.S. Pat. No. 5,095,815, Mar. 17, 1992. These two devices are, to the best of the applicant's knowledge the most closely related prior art.

Morlock, U.S. Pat. No. 4,573,405 discloses a crusher that comprises a vertically oriented rotatable drum, which is an idler drum driven by the crusher, in which is mounted a crushing roller. The crushing roller, which is power driven, and which drives the drum, is a metal cylindrical structure having ribs on the exterior positioned such that a nip is formed between the inner surface of the drum and the outer surface of the crusher, the nip being capable of opening against a resilient bias. The structure of the drum and the crusher requires that the crusher be made of a very strong material, e.g., a metal such as steel. One of the problems with this kind of a device generally is that aluminum has a very high propensity to gall and tends to jam the crusher as the aluminum cans are crushed and are retained on the surface of the crusher or the drum, or fragments are collected on the drum or the crusher. Another problem is that the presence of ice, which accumulates in cold weather, or the presence of plastic or glass may prevent driving engagement of the drum by the roller and result in a jam rendering the entire device inoperable.

The Baumgartner invention, U.S. Pat. No. 5,095,815, is similar in most essential respects to the device of Morlock but incorporates projections on the interior of the drum and provides a scraper to try to keep the drum and the crusher clean of galled aluminum cans or aluminum fragments.

It is an object of this invention to overcome the jamming and galling problems of these prior art devices and other similar devices.

Another can crushing device is disclosed by Newman, U.S. Pat. No. 4,444,100, Apr. 24, 1984. This can crusher is similar in most respects to the devices previously described but is provided with a slide guide that directs the cans into the nip between the roller and the drum. This device suffers from the aluminum galling problem previously discussed.

Other can crushers are disclosed in U.S. Pat. No. 4,316,410 to Davis, Feb. 23, 1982, U.S. Pat. No. 3,776,128 to Morris, Dec. 4, 1973, U.S. Pat. No. 4,235,164 to Allen, et al., Nov. 25, 1980, U.S. Pat. No. 3,827,351 to Rosnow, Aug. 6, 1974 and to Malrsky, U.S. Pat. No. 3,036,517, May 29, 1962. These latter devices use mechanisms quite different from those previously discussed.

Interestingly, fruit crushers are known to use a generally similar arrangement of a rotating drum with a rotating crusher roller mounted inside the drum. Obviously, the problems faced differ in crushing fruit than in crushing aluminum cans and the specific problem of galling of aluminum and jamming of the crushing mechanism is not present. Such crushers are disclosed, for example, in U.S. Pat. No. 4,355,473, to Berry, Aug. 26, 1982 and U.S. Pat. No. 1,655,333, to Perazio, Jan. 3, 1928.

The present invention overcomes the problems of the prior art by incorporating a number of features which work together in combination to result in a can crusher which is reliable and wherein there is originally no tendency to jam as a result of crushed cans or fragments of cans or aluminum buildup or the jamming of crushed cans in the mechanisms.

SUMMARY OF THE INVENTION

The present invention is an improved aluminum beverage can crusher. The crusher comprises a catch drum comprising a right cylinder having open ends, an axis, an inner cylindrical surface an outer cylindrical surface positioned by means for mounting the catch drum with the axis thereof fixed in a vertical orientation to thereby define an upper open end and an open bottom end of the drum. Power driven means for rotating the catch drum about said axis in a predetermined direction of rotation are provided in the invention. Crushing is accomplished by means of a resilient crusher roller comprising a right cylinder having a diameter generally in the rage of from about one-half to about two-thirds the internal diameter of the catch drum. The drum has an external generally cylindrical surface and a central axis. Means are provided for mounting the crusher roller inside the catch drum with the axis of the crusher roller displaced from the axis of the drum and defining, on one side of the crusher roller, a nip of about one-half inch between the external surface of the resilient crusher roller and the inner cylindrical surface of the catch drum. This mounting provides, on the other side of the crusher roller, a can receiving space for receiving uncrushed aluminum beverage cans in the catch drum between the internal wall of the drum and the external wall of the crusher roller. Means for rotating the resilient crusher roller about its axis cause the crusher roller to rotate at a rotational rate that results in external surface velocity of the resilient crusher being approximately the same as the velocity of the internal surface of the catch drum for reducing shear forces in the nip. While the same ultimate source of power may be used to drive both the drum and the roller, an important facet of this invention is that the drum and the roller are separately power driven for relative rotation; i.e., the roller does not engage and does not drive the drum. Means are provided for supporting uncrushed cans in the receiving space while permitting crushed cans to drop from the bottom open end of the catch drum.

The means for supporting uncrushed cans preferably comprises a can support comb supported proximate the bottom open end of the catch drum in the can receiving space, said can support comb comprising means on one end for preventing cans from being caught on said comb. The can support comb also comprises can guide projections extending toward the tuner surface of the catch drum.

In the preferred embodiment, the resilient crusher roller defines in the external surface thereof a plurality of can grabber grooves extending substantially the length of said external surface.

Also, in the preferred embodiment, the resilient crusher roller further comprises a crushed can remover blade mounted for rotation with said roller proximate the bottom open end of the catch drum.

In the preferred embodiment the catch drum may further comprise a plurality of jammed can remover projections extending inwardly from the inner cylindrical surface thereof.

DESCRIPTION OF THE PREFERRED EMBODIMENT

In the following description, specific examples of constructions are given with the caveat that many variations and alternatives are available within the scope of the invention. In the discussion of the essential components of the invention, it would be understood that not every one of these components is essential in all embodiments but that each performs an important function. Structures which perform the same functions may be substituted without departing from the invention.

Figure 1:
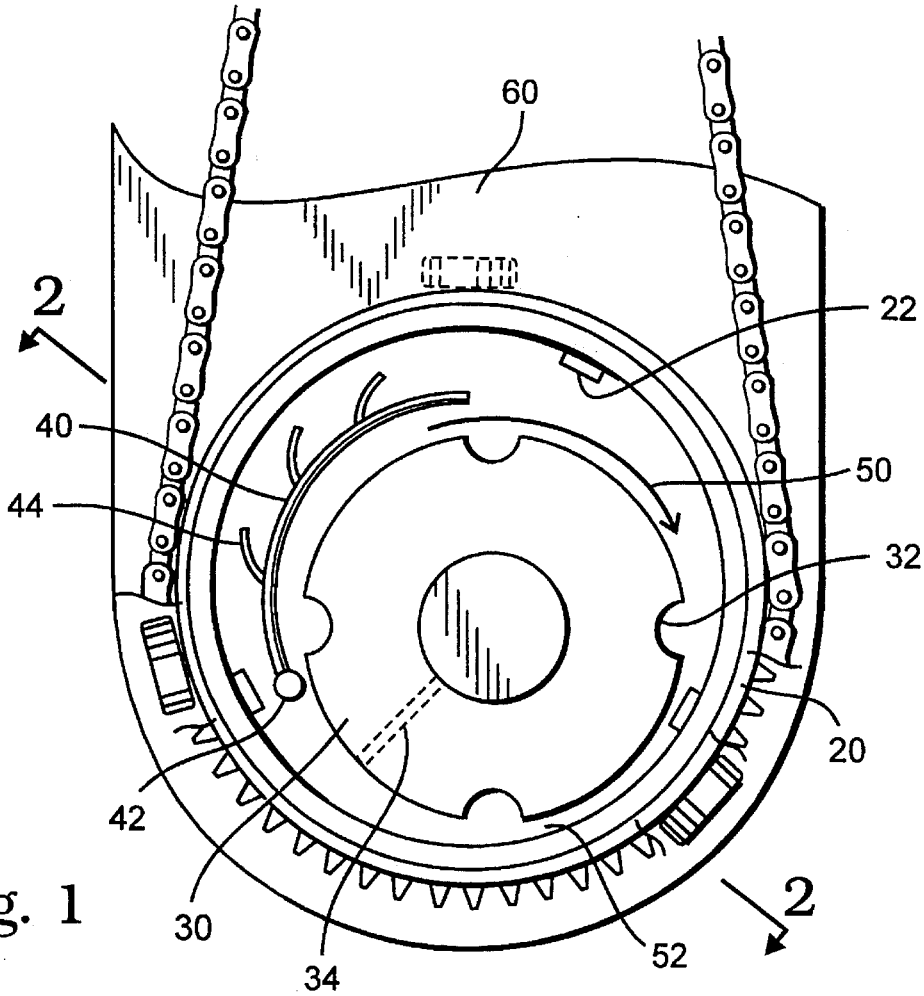
FIG. 1 is a partially schematic top plan view showing the essential features of the present invention.
Figure 2:
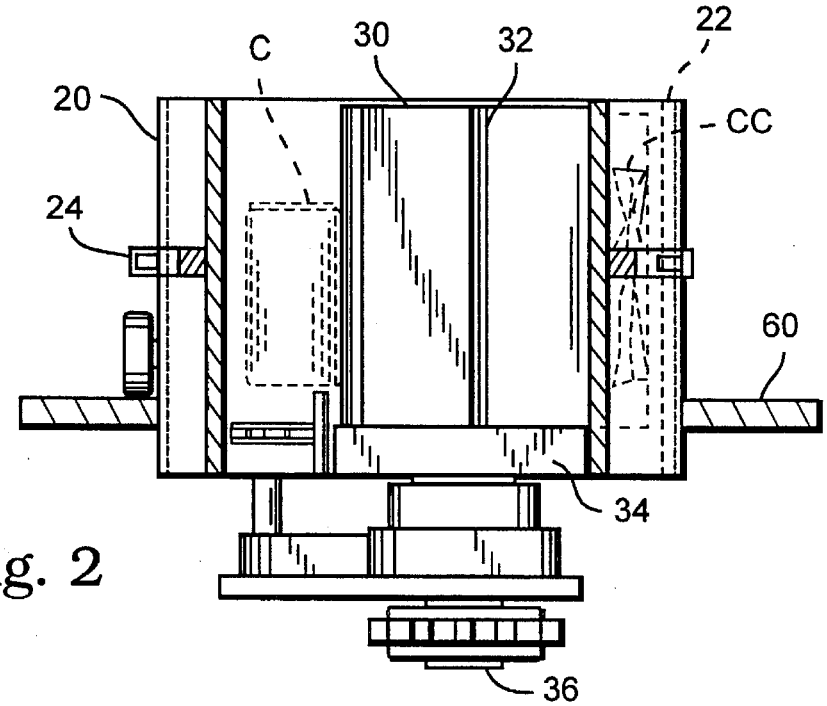
FIG. 2 is a slight elevational view of the crusher drum, shown partially schematically to illustrate, again, the essential features of the present invention.

Referring now to FIG. 1 and FIG. 2, the invention comprises a catch drum 20 which has affixed to or formed on the inside of the drum jammed can removers 22, which also function as empty can drivers, and which is provided with a drum rotator 24. The drum 20 may be of any rugged material. For example, the drum 20 may be of steel with the .jammed can driver ribs 22 formed integrally or attached thereto, or of plastic such as schedule 40 PVC (polyvinyl chloride) pipe or ABS (acrylonitrfle butadiene styrene), with the jammed can driver ribs attached or formed integrally. Virtually any metal or other hard material may be used, although aluminum should probably be avoided because of the tendency of aluminum to gall with aluminum cans. Tough plastics having some self-lubricity, such as polyacetals, polycarbonates, nylons and alloys of the same, are good candidates.

The drum is a right cylinder having interior and exterior cylindrical surfaces. The cylinder is mounted, in use, vertically and, except for a can support comb and rotating structure, is open at the bottom so that the cans, as they are crushed, simply fall out the bottom of the drum. The drum is supported by any convenient means, one of which will be disclosed later, for rotation about its axis. Drum rotator means 24, and the exemplary embodiment being a ring gear secured to the outer circumference of the drum, is provided to rotate the drum with rotational power being provided by the desired means. As will appear from the subsequent discussion, many rotational means and structures can be provided, those disclosed being merely exemplary and non limiting in character.

A resilient crusher roller 30 which is a right cylindrical body is mounted in the drum. The resilient crusher roller is of a height approximating the height, or length, of the cylinder, although exact coincidence is not required. The resilient crusher roller has a diameter approximately two-thirds the diameter of the drum. The exact ratio of drum diameter to crusher diameter is not critical, however, and a crusher roller diameter from about one-haft to about three-fourths the diameter of the interior of the drum will be satisfactory. It has been found to be very important that the crusher roller be resilient. A non-resilient crusher roller tends to jam as aluminum or aluminum fragments gall and adhere to the crusher roller. By using a resilient crusher roller, the tendency to jam as a result of galling of aluminum is greatly diminished and substantially eliminated. The resilient crusher roller is mounted for rotational movement eccentric to the interior of the drum forming a nip between the drum and the crusher roller of approximately one-half inch, although the exact gap forming the nip is not critical. The resilient crusher roller preferably has formed in its outer surface a plurality of grooves extending from one end to the other of the roller. These can grabber grooves 32 prevent a can from simply sliding on the surface of both the roller and the drum and, thereby, forces the can into the nip. Roller rotator means 36 are provided to rotate the resilient crusher roller. The roller rotator drives the roller for rotational movement at a rotational rate that results in external surface velocity of the resilient crusher being approximately the same in the nip as the velocity of the internal surface of the catch drum for reducing shear forces in the nip. There are inevitable shear forces applied through the crushed and being-crushed can between the roller and the drum. These shear forces are absorbed by the resiliency of the crusher without requiring that the can slip on either the drum surface or the roller surface.

The gap on the opposite side of the drum from the nip is large enough to easily accept a beverage can. Typically, the gap would be about four inches at its maximum width, although it could be as narrow as three inches or as wide as five or six inches, or even wider. Since the bottom of the drum is open, it is necessary to provide means to support the can long enough for the can to be carried into the nip and crushed. By the same token, it is important that crushed cans not be permitted to remain in the crushing mechanism.

A can support comb 40 is provided in the lower portion of the cylinder 20 in the can receiving space between the resilient crusher roller 30 and the interior of the catch drum 20. The can support drum prevents an uncrushed can from falling through the cylinder and out the bottom. One of the valuable features of the present invention is the provision of a vertical anti-spear rod 42 (so called because it prevents spearing of cans by the comb) on the leading end of the can support comb 40 to prevent cans from collecting on the forward end of the can support comb. Another important feature of the invention is the provision of can guide projections 44 on the comb extending outwardly toward the interior surface of the drum. These can guide projections 44 interact with the jammed can driver ribs 22 mounted or formed on the interior of the drum to drive a partially crushed can that might otherwise be jammed in the mechanism toward the nip to complete the crushing. Though many details of the preferred embodiment have not yet been described in detail, it is now possible to describe the essential features of the invention and the functioning of the invention. Referring again to FIGS. 1 and 2, with specific reference to FIG. 2, a can C can be dropped into the can receiving space where it is supported on the can support comb 40. The can is driven by its contact with the external surface of the resilient crusher roller 30, and the can grabber grooves 32 therein, or by the interior surface of the catch drum 20 and the jammed can drivers 22 thereon. The can moves, referring to FIG. 1, clockwise as shown by the barrel 50, in FIG. 1, from the can receiving space toward the nip 52, again referring to FIG. 1. As the can passes through the nip, it is crushed into a generally rectangular object, the crushed can being indicated in FIG. 2 by the identifier CC. The exact configuration of the crushed can will vary, of course, depending on how the can enters into the nip and whether or not it has been partially crushed or deformed before it enters the nip. Once crushed, the can tends to fall out the bottom of the cylinder into a catch basket which is not shown, or onto a conveyer which carries it to a storage bin or storage compartment. Sometimes, if two or more cans enter the nip at the same time or if a can is irregularly crushed, it may tend to try to stay in the crushing mechanism. If the crushed can tries to stay in the crushing mechanism, it is carried back into the can receiving area where it passes by the anti-spear rod 42 of the can support comb 40 and, if it passes outside the comb, it is forced toward the drum surface by the can guide projections 44 and is returned to be further crushed at which time it will, most simply fall out of the bottom of the drum, There is a mechanism provided underneath the drum for rotating the resilient crusher roller 30. If a can should drop onto this mechanism, there would be a tendency for the can to remain in place and it could possibly jam the crushing mechanism. A crushed can remover blade 34 is provided, however, on the bottom of the resilient crusher roller. The crushed can remover blade 34 extends outwardly from the central portion of the resilient crusher roller 30 and at the bottom end of the resilient crusher roller per se. This crushed can remover blade 34 rotates with the crusher roller and dislodges any crushed can that may tend to rest on the support mechanism for the rotator for the resilient crusher roller.

It will be noted that the space between the crusher roller 30 and the forward end of the can support comb 40, formed by the anti-spear rod 42, is less than the space between the crusher roller and the comb at any subsequent position on the comb. Thus, the crushed can which passes between the resilient crusher roller 30 and the can support comb 40 will continue to pass back into the nip without being caught in the space between the roller and the comb.

Figure 6:
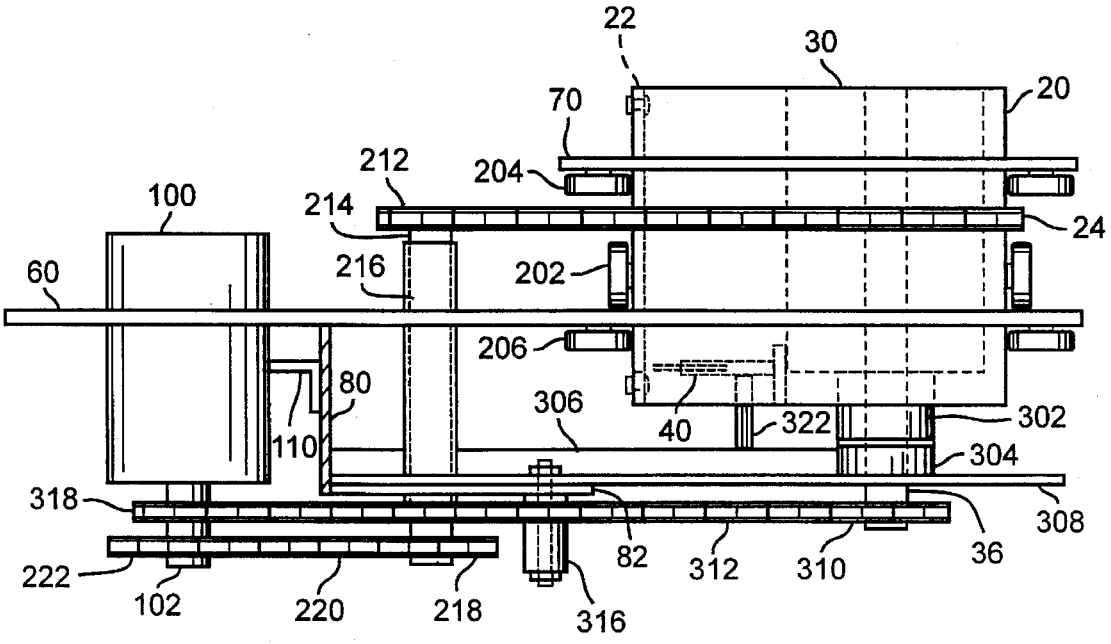
FIG. 6 is a side elevational view in partial cross-section, and partial schematic, showing the drive mechanisms for the various components and their vertical relationship to each other.

With continuing reference to FIGS. 1 and 2, and with further reference to FIG. 3 and FIG. 6, the drive mechanism in the preferred embodiment for the drum will be described. Referring first to FIG. 6, it will be noted that the crusher is mounted on a generally rectangular plate 60 about which is supported a plate 70 and below which is supported a bracket 80 which comprises a plate 82.

Figure 4:
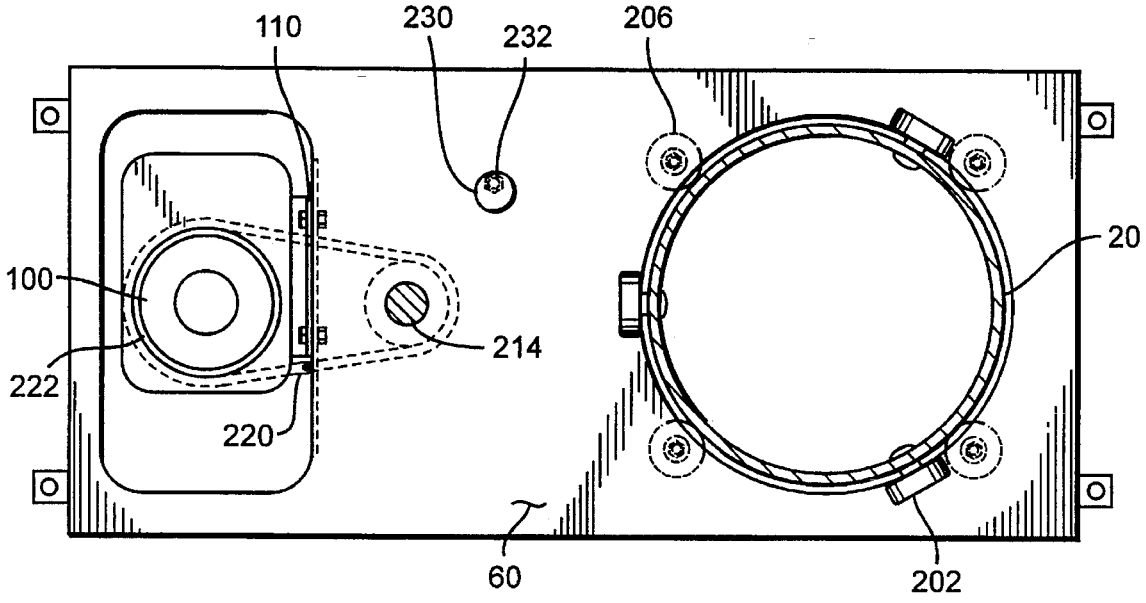
FIG. 4 is a top plan view with some components removed, as respect to FIG. 3, showing the support mechanism for the drum.

With continuing reference to FIG. 6, and also reference to FIG. 4, the drum is supported by a plurality of wheels 202 secured to the outside of the drum by bolts or other suitable fasteners. In the preferred embodiment, three such wheels are provided but four or more may be provided if desired.

The wheels roll on the upper surface of the plate 60 and provide vertical support for the catch drum 20. Two sets of guide rollers 204 and 206 respectively, maintain the axis of rotation substantially constant during rotation. The rollers 204 are mounted on the plate 70 and the rollers 206 are mounted on the bottom side of the plate 60, in the preferred embodiment. By the use of these two sets of rollers, the orientation of the drum 20 is maintained and its axis of rotation is fixed.

The drum rotator 24 is driven by a chain 210 which, in turn, is driven by a sprocket 212 mounted on a shaft 214. Making reference to FIG. 6, the shaft 214 is journaled in a long bearing 216 which extends between the plate 60 and the plate 82 and secures the shaft 214 so that it rotates about a single axis. A sprocket 218 is driven by a chain 220 which, in turn, is driven by a sprocket 222 which is driven by the shaft 102 of motor 100. The motor 100, which is preferably a gear motor, but can be any kind of motor of sufficient power, is mounted in any suitable way. In the preferred embodiment, it is mounted by way of a bracket 110 to the bracket 80 by bolts or other fastener mechanisms.

The drive mechanism for the drum, then will be seen to be initially the motor 100 which is the source of power, through the shaft 102 the sprockets 218 and 222 by chain 220, and the sprocket 212 and the chain 210 which engages the teeth on the drum rotator sprocket 24. The drum is permitted to rotate by means of the support wheels 202 which ride upon the plate 60 and its axis of rotation is fixed by means of the guide wheels 204 and 206, the set of guide wheels 204 being secured to plate 70 and the set of guide wheels 206 being secured to plate 60. Roller skate or skateboard wheels are conveniently available and function effectively to support the cylinder and to guide the rotation of the cylinder about an axis. Bearings, alone, or bearing mounted wheels of any kind may be used to support and guide the drum, The tautness of the chain 210 may be maintained or adjusted by a Teflon® (du Pont polytetrafluoroethylene), or other self-lubricating guide 230 which, in the preferred embodiment, is eccentrically mounted on the bolt 232. An idler wheel may, of course, be used to maintain tautness of the chain, as may be any other mechanism which can be positioned so as to roll or ride against the chain and maintain it in any of these desired degrees of tautness.

Figure 3:
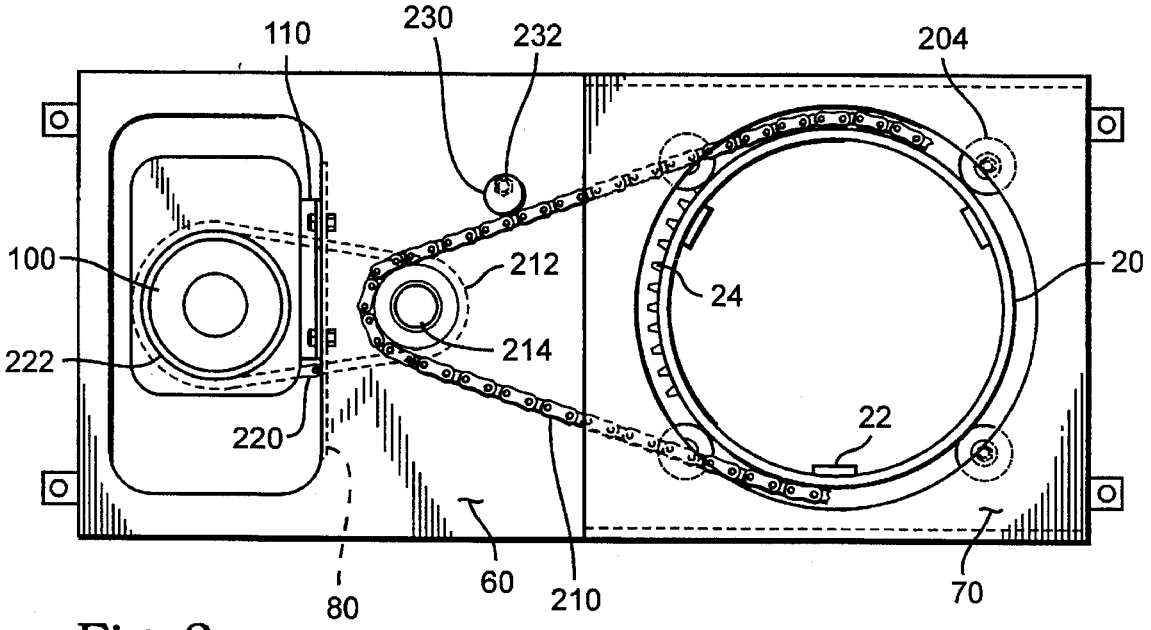
FIG. 3 is a top plan view showing the drive mechanism for the drum.
Figure 5:
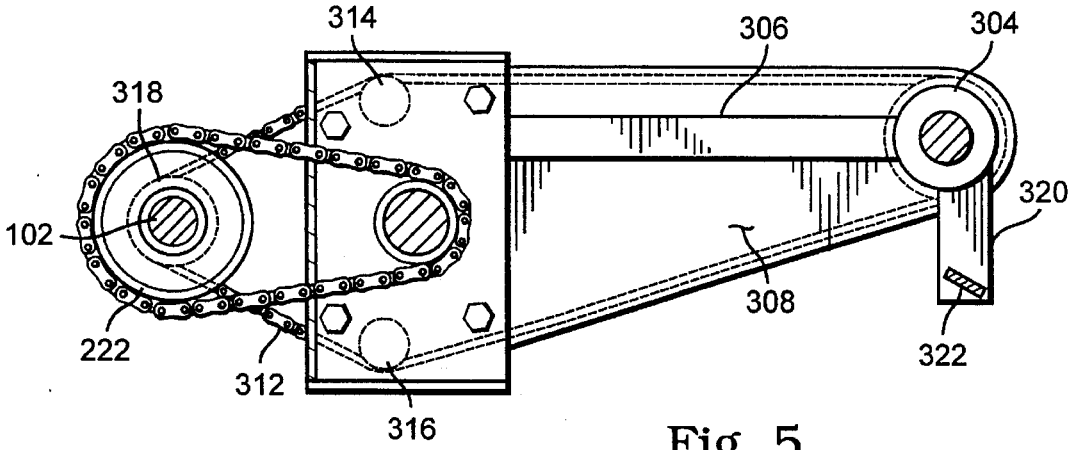
FIG. 5 is a top plan view with the upper structures being omitted, showing the drive mechanism for the crusher rubber.

A somewhat simplified drawing, with many components omitted, is shown in FIG. 3. Making reference now to FIGS. 5 and 6, the drive mechanism for the resilient crusher roller will be described. The roller rotator 36 of the resilient crusher roller is supported by a spacer 302 and a bearing 304 mounted on a bar 306 and a plate 308 which are, in turn, secured to the plate 82 and the bracket 80. This arrangement provides for the crusher roller to be mounted in a vertical orientation on an axis of rotation which is parallel to the axis of rotation of the catch drum 20. The roller rotator 36 is driven by means of a sprocket 310, chain 312 and idlers 314 and 316 and by sprocket 318 which is driven by the shaft 102 of motor 100. In this manner, the motor 100 provides power for both the rotation of the crusher roller and the catch drum. By gearing arrangements, however, the rotation of the catch drum 20 and the resilient crusher roller 30 are different such that there is no coincidence of location as between the catch drum and the resilient crusher roller.

The idlers 314 and 316 may be idler rollers mounted on bearings or may simply be a self-lubricating idler made of Teflon, for example, which maintains the position of chain 312 and keeps the chain taut.

The side bar 320, bearing an upright support 322 position the can support comb 40 in the location as previously described. The plate 308 is not necessarily required for support, but is provided to prevent the cans from dropping directly on the chain 312. While no particular criticality is attributed to materials, other than to the resilient crusher roller, it is necessary that the assembly be very ruggedly built to withstand the vibration and the stresses created during the crushing operation.

The resilient crusher roller is custom made. Many materials were evaluated and many were used in earlier prototypes of the present invention without success or with limited success. The requirements for the resilient crusher roller were found to correspond reasonably closely to the requirements for heavy duty vehicle tires. The material must be resilient and yet very tough and resistant to cuts and abrasions. In general, those resilient materials suitable for fabrication of heavy duty vehicle tires will be suitable for use in manufacturing the resilient crusher roller. In the preferred embodiment, carbon filled vulcanized natural rubber was found to be the most desirable material from the point of view of having excellent resilience and toughness. The resilience is necessary to prevent jamming of the crushing device by the adhesion of aluminum cans or fragments or simply the build up of aluminum on the crusher roller.

It is pointed out, again, that while a specific set of mechanisms for driving the crusher have been disclosed, other drive mechanisms could be used with equal success. For example, two motors could be used, one to drive the drum and one to drive the crusher roller. Mechanical linkages by way of gears or gear boxes or V-belts could be used.

Thus, it would be apparent that many alterations and variations can be made without departing from the scope and content of the invention, as defined in the appended claims.

Industrial Application

This invention is useful in environmental industries and particularly in the recycling of aluminum beverage cans.

What is claimed is:

1. An aluminum beverage can crusher comprising, in combination:

a catch drum comprising a right cylinder having open ends, an axis, an inner cylindrical surface, an outer cylindrical surface;

means for mounting the catch drum with the axis thereof fixed in a vertical orientation to thereby define an upper open end and a bottom open end of the drum;

means for rotating the catch drum about said axis in a predetermined direction of rotation;

a resilient crusher roller comprising a right cylinder having a diameter of from about one-half to about two-thirds the internal diameter of the catch drum, an external generally cylindrical surface and a central axis;

means mounting the resilient crusher roller inside the catch drum with the axis of the crusher roller displaced from the axis of the drum and defining, on one side of the crusher roller, a nip of about one-haft inch between the external surface of the resilient crusher roller and the inner cylindrical surface of the catch drum and, on the other side of the crusher roller, a can receiving space for receiving uncrushed aluminum beverage cans in the catch drum between the internal wall of the drum and the external wall of the crusher roller;

means for rotating the resilient crusher roller about its axis at a rotational rate that results in external surface velocity of the resilient crusher being approximately the same as the velocity of the internal surface of the catch drum for reducing shear forces in the nip; and means for supporting uncrushed cans in the receiving space while permitting crushed cans to drop from the bottom open end of the catch drum.

2. The beverage can crusher of claim 1 wherein the means for supporting uncrushed cans comprises a can support comb supported proximate the bottom open end of the catch drum in the can receiving space, said can support comb comprising means on one end for preventing cans from being caught on said comb.

3. The beverage can crusher of claim 2 wherein the can support comb further comprises can guide projections extending toward the tuner surface of the catch drum.

4. The beverage can crusher of claim 1 wherein the resilient crusher roller defines in the external surface thereof a plurality of can grabber grooves extending substantially the length of said external surface.

5. The beverage can crusher of claim 1 wherein the resilient crusher roller further comprises a crushed can remover blade mounted for rotation with said roller proximate the bottom open end of the catch drum.

6. The beverage can crusher of claim 1 wherein the catch drum further comprise a plurality of can driver projections extending inwardly from the inner cylindrical surface thereof.

7. An aluminum beverage can crusher comprising, in combination:

a catch drum comprising a right cylinder having open ends, an axis, an inner cylindrical surface, an outer cylindrical surface;

means for mounting the catch drum with the axis thereof fixed in a vertical orientation to thereby define an upper open end and a bottom open end of the drum;

means for rotating the catch drum about said axis in a predetermined direction of rotation;

a resilient crusher roller comprising a right cylinder having a diameter of from about one-half to about two-thirds the internal diameter of the catch drum, an external generally cylindrical surface defining in said external surface a plurality of can grabber grooves extending substantially the length of said external surface, and a central axis;

means mounting the resilient crusher roller inside the catch drum with the axis of the crusher roller displaced from the axis of the drum and defining, on one side of the crusher roller, a nip of about one-half inch between the external surface of the resilient crusher roller and the inner cylindrical surface of the catch drum and, on the other side of the crusher roller, a can receiving space for receiving uncrushed aluminum beverage cans in the catch drum between the internal wall of the drum and the external wall of the crusher roller;

means for rotating the resilient crusher roller about its axis; and means for supporting uncrushed cans in the receiving space while permitting crushed cans to drop from the bottom open end of the catch drum.

8. The beverage can crusher of claim 7 wherein the resilient crusher roller further comprises a crushed can remover blade mounted for rotation with said roller proximate the bottom open end of the catch drum.

9. The beverage can crusher of claim 8 wherein the means for supporting uncrushed cans comprises a can support comb supported proximate the bottom open end of the catch drum in the can receiving space, said can support comb comprising means on one end for preventing cans from being caught on said comb.

10. The beverage can crusher of claim 9 wherein the can support comb further comprises can guide projections extending toward the inner surface of the catch drum.

11. The beverage can crusher of claim 7 wherein the means for supporting uncrushed cans comprises a can support comb supported proximate the bottom open end of the catch drum in the can receiving space, said can support comb comprising means on one end for preventing cans from being caught on said comb.

12. The beverage can crusher of claim 11 wherein the can support comb further comprises can guide projections extending toward the inner surface of the catch drum.

13. The beverage can crusher of claim 12 wherein the catch drum further comprise a plurality of can driver projections extending inwardly from the inner cylindrical surface thereof.

* * * * *